United States Patent [19]

André

[11] 3,998,140

[45] Dec. 21, 1976

[54] MACHINE FOR MANUFACTURING CORRUGATED STRUCTURES

[75] Inventor: Claude Maurice André, Elancourt, France

[73] Assignee: Sofited 2, Saint Ouen, France

[22] Filed: July 2, 1975

[21] Appl. No.: 592,656

[30] Foreign Application Priority Data

May 7, 1975 France ..... 75.14434

[52] U.S. Cl. ..... 93/84 R; 93/58.1; 93/60; 156/443

[51] Int. Cl.[2] ..... B65H 45/20

[58] Field of Search ..... 156/209, 219, 553, 443, 156/474; 93/84 R, 1 H, 1 R, 60, 58 R, 58.1, 58.2 R

[56] References Cited

UNITED STATES PATENTS

| | | | |
|---|---|---|---|
| 2,697,970 | 12/1954 | Tipper | 156/474 UX |
| 2,950,656 | 8/1960 | Gewiss | 93/1 H |
| 3,135,174 | 6/1964 | Gewiss | 93/84 R |
| 3,306,794 | 2/1967 | Humbert, Jr. | 156/474 X |

*Primary Examiner*—James F. Coan
*Attorney, Agent, or Firm*—Cushman, Darby & Cushman

[57] ABSTRACT

The invention concerns a machine for the continuous manufacture of corrugated filter structures out of a thin strip. On the two sides of the thin strip, by means of marking lines, a series of impressions are marked for the purpose of beginning the formation of longitudinal folded ribs, the strip thus marked being pushed through a passage having an evolving shape and longitudinal ribs, for the purpose of compressing the strip transversely as well as longitudinally, and the folded structure coming out of such passage being cut at will.

15 Claims, 10 Drawing Figures

Fig. 5.
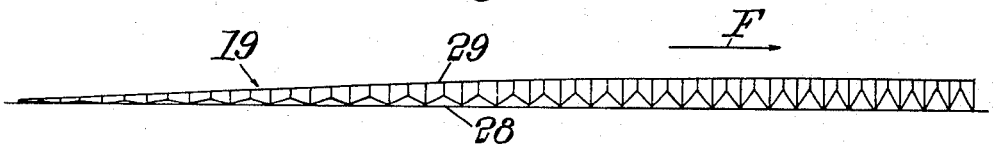
Fig. 6.
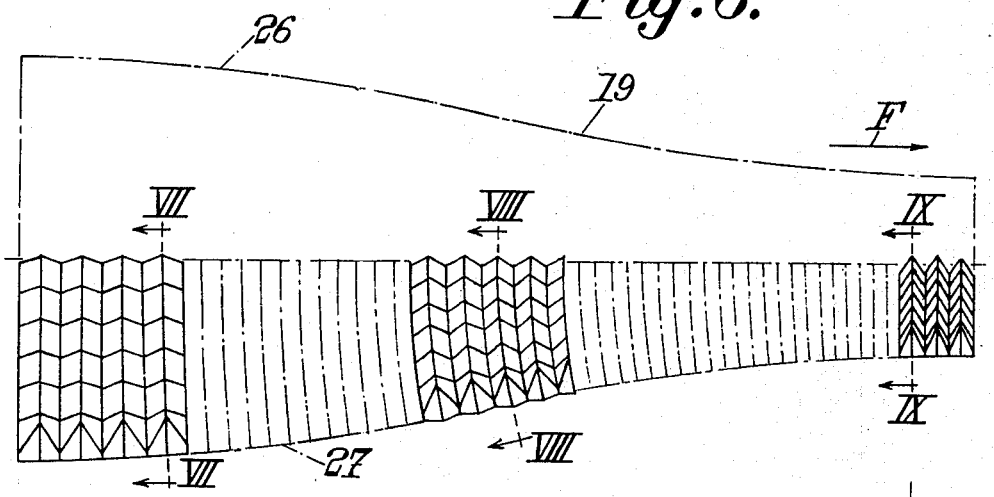
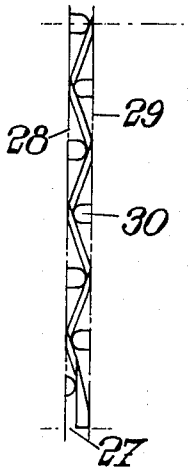
Fig. 7.
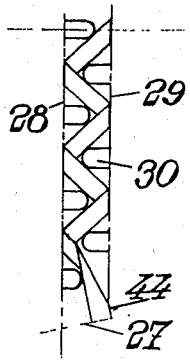
Fig. 8.
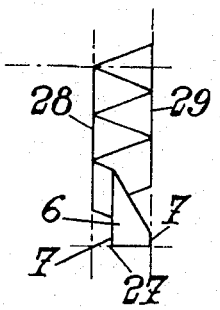
Fig. 9.

MACHINE FOR MANUFACTURING CORRUGATED STRUCTURES

This invention relates to machines for making flexible corrugated filter structures and to the filter structures themselves. The filter structures have on both sides a series of parallel folded ribs which have ridges cut along a zigzag line and corresponding to a series of cavities on the other side, the ridge of each rib being connected to the bottom line of the contiguous cavity by a folded side consisting of a series of facets in the shape of parallelograms.

BACKGROUND OF THE INVENTION

It is known that corrugated filter structures are used, among other purposes, in the manufacture of filter cartridges, generally of a cylindrical shape, to filter fluids such as air, oil and gasoline which circulate inside internal combustion engines, notably for automotive vehicles.

In order to simplify the following description, and, of course, without limiting the scope of the invention, it will be assumed that, in the machines under consideration, a strip of filtering material is fed from a reel having a horizontal axis and runs with the direction of its width practically horizontal, specifically being guided or rolled at least partially on rollers having a horizontal axis. However, it will be understood that a strip may also run vertically.

More specifically, among the machines of the type mentioned above, the invention covers those that include two parallel rollers marking the axes, placed on either side of the passage of the strip, respectively, and driven synchronously in order to mark on both sides of the strip impressions marking the ridges of the ribs and the folds of the corrugated structure. Each roller is fitted with first and second sets of projecting marking lines corresponding, respectively, to the ridges of the ribs and to the folds in the sides of such ribs or cavities. A guide passage, limited on its sides by two walls, converges toward its outlet and means are provided to propel the structure to be folded through the passage at a constant speed.

In the known methods of construction of these machines, the general direction of the folded ribs was transversal, that is, perpendicular to the general direction of passage of the strip through the machine, and the folding was achieved basically by means of combs, blades, wedges or other forming elements subjected to alternating motions and acting upon the two sides of the strip in turn at the place where it enters into the guide passage. Such methods of construction ensure continuous manufacturing and present a certain number of advantages.

SUMMARY OF THE INVENTION

The present invention suggests other methods of construction, which offer even more advantages, in comparison with the known methods, notably with respect to the sturdiness and the low cost of the machines themselves, on the one hand, and, on the other hand, the possibility of obtaining high production rates and increased width of the corrugated structures thus obtained, as well as the possibility of compressing such structures along their length until their folds are closed and nearly connected, and this without subjecting the strip to stresses that might cause crumpling or tears.

For this purpose, the machines designed according to this invention are basically characterized by the fact that the marking is such that the folded ridges run along the length of the strip and by the face that the passage is fixed and delimited by two smooth walls, progressively diverging toward the outlet, in such manner that the transverse section of the entrance of such passage is practically complementary to the flattened rectangular section of the marked unfolded strip. Each transversal plane section of the said passage closely surrounds the section of the structure undergoing folding along the same plane, and the two diverging walls are also fitted with smooth longitudinal guiding ribs, the height of which increases in the direction of the outlet and the median lines of which converge in the direction of the outlet, running along the median lines of the cavities included among the folded ribs to be formed.

In the preferred methods of construction, moreover, one and/or more of the following arrangements have been resorted to:

a. The marking is also such that the margins of the structure that is being folded remain practically perpendicular at all their points to the lateral walls of the passage along which they slide.

b. The marking is also such that the angle formed between the longitudinal direction of the strip and the zigzagging marking impressions on such strip intended to determine the ridges of the ribs ranges between 10° and 30°.

c. The first set of marking lines on each of the two marking rollers run along annular zigzagging lines that are parallel and equidistant and centered on the axes of the rollers, and the second set of marking lines on each of the said rollers run parallel to the axes of the latter from the corner points of the said zigzagging lines, along the external bisectors of the corresponding angles, and the second set of lines that originate from two successive annular zigzagging lines and that are oriented toward each other overlap each other.

d. The first set of marking lines that constitute the two marginal annular zigzagging lines of one of the two marking rollers form with a plane perpendicular to the axis of the roller an angle $b$ that is considerably wider than the angle $a$ formed between the other first set of marking lines of the same roller and the said plane and the other roller is fitted in its marginal area with a third set of projecting marking lines parallel to the axis of the roller, which extend at least from the transversal planes of that roller, that correspond to the edges of the strip along the internal bisectors of the angles formed between the adjacent marginal annular zigzagging lines of those planes.

e. The angle $b$ is practically equal to $45° + a/2$.

f. From their upper extremity corresponding to the entrance of the guide passage, the lateral walls of the passage are gradually inclined toward the outside, beginning with an initial vertical position, and then gradually straighten up until they are vertical again at the end of the passage.

g. Provision is made for wheels that partly project across openings cut in at least one of the walls of the guide passage, and the profile of such wheels and their position are arranged in such manner that, operating together with the structure undergoing folding by touching such structure, they make possible to rectify and complete such folding.

Apart from these main arrangements, the invention includes some other arrangements that are used preferably simultaneously and that will be described more fully below.

DETAILED DESCRIPTION

The following is a description of one of the best methods of realizing this invention and refers to the drawings annexed hereto, of course without limiting its scope.

FIGS. 5 and 6 are a side view and a top view, respectively, of the structure while it is being folded inside the passage in the machine.

FIGS. 7, 8 and 9 are transversal half-sections of the passage and of the structure at the lines VII—VII, VIII—VIII and IX—IX in FIG. 6, respectively.

Figure 1:
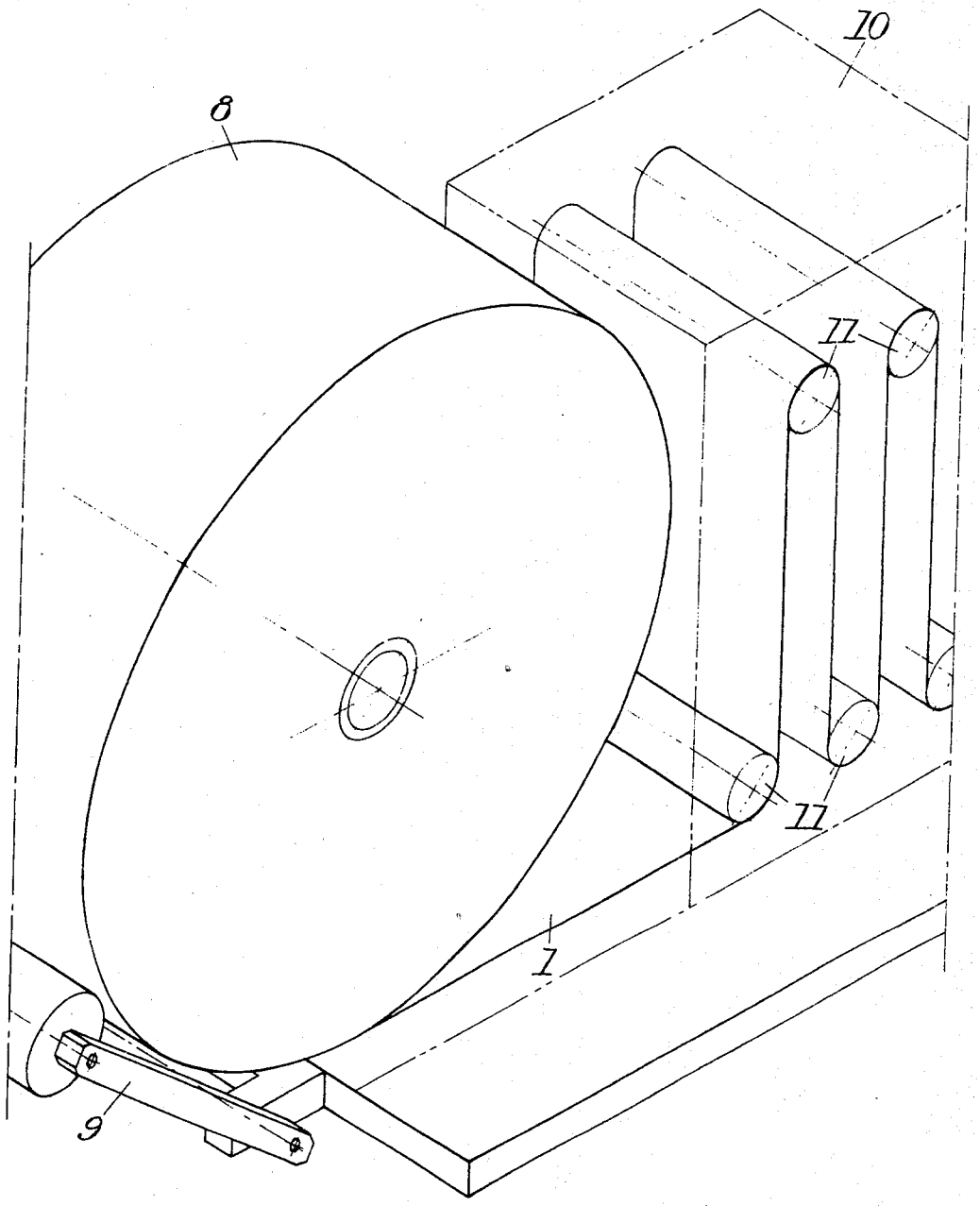
FIGS. 1, 2 and 3 are perspective views of the top, central and bottom part, respectively, of a machine for the manufacture of folded structures designed according to the invention.

The machine under consideration is used for manufacturing, out of a thin strip 1 (FIGS. 1, 2 and 4) of filter paper, a flat and flexible structure 2 (FIG. 3) that presents on each of one of its two sides a series of parallel folded ribs 3, in which the ridges 4 of the ribs extend lengthwise, that is, along the direction in which the strip runs through the machine, and have the shape of lines cut along a zigzag pattern.

The two sides of the structure are analogous, and each rib on one of the sides corresponds to a cavity on the other side; therefore, the bottom lines of the cavities are also lines cut along a zigzag pattern, and each bottom line is connected to each ridge of the two adjacent ribs by a side face, folded along ridges 5, consisting of facets in the shape of parallelograms.

The structure 2 here is limited by two longitudinal margins 6, folded along a succession of simple dihedral angles, the ridges 7 of which are composed of transverse straight segments.

As is self-evident, such a structure can then be pressed lengthwise until its folds are closed and nearly connected, and then rolled in the shape of a cylinder or truncated cone, partially or entirely, so as to form a filter element.

Such filter elements, or the entire cartridges that contain them, are usefully employed as disposable pieces after use, for the purpose of filtering air, gasoline or oil in internal combustion engines, particularly in those of vehicles.

It should be noted that the longitudinal arrangement of the folded ribs of the structure described above differs from the transverse arrangement used in the machines presently known for the manufacture of such structures.

Moreover, the folded ribs have nothing in common with the corrugated ribs in certain known structures that cannot be compressed lengthwise, that is, in the general direction of the corrugated ribs, without causing tears in the paper.

Such lengthwise arrangement makes possible to ensure the desired formation of ribs-folds simply by pushing the strip, previously marked with impressions cut where the folds are located, in a guide passage with ribbed smooth walls presenting an evolving transverse section shaped to surround the strip closely during its entire process of transformation into the desired structure.

The outer profile of the section evolves gradually from the shape of an horizontal segment practically corresponding to the transverse section of the original strip before processing to a practically rectangular shape, less wide and higher than the preceding one, shaped to surround closely the folded structure that is obtained.

Inside such profile, as will be described later in greater detail, the said section of the passage is not entirely open; a series of projections set inside the passage gives the grooved section of the latter the general shape of a fret, so that the strip pushed into the passage is forced to alter its shape along the desired rib lines.

In order to reinforce the pressure on the strip, it is also possible to slow down the structure when it leaves the passage and/or put it in contact with grooved wheels that present cavities and reliefs corresponding to the opposite reliefs and cavities to be formed, respectively.

In the method of construction more specifically illustrated, the machine includes an initial spool 8 (FIG. 1) with a horizontal axis, for the purpose of feeding the strip 1; for this purpose, the shaft of the spool 8 may be driven in a known manner by an appropriate motor-brake assembly. A feeling arm 9 makes possible, in a known manner, the detection and regulation of the linear speed at which the strip 1 unwinds, for the purpose of keeping such speed constant. A chamber 10 is provided in which the strip 1, guided by the rollers 11, is humidified and/or dried for the purpose of controlling its hygrometric properties. Two marking rollers 12 and 13 (FIGS. 2 and 4) are located above and below the strip 1, respectively, and arranged to operate each in conjunction with a counter-roller (14, 15) covered by a soft layer 16, made of elastomer. Two driving rollers 17 and 18 synchronized with the marking rollers 12 and 13 enclose between them the strip 1 after marking. At the end of a guide passage 19 there is located a fold counter 20 (FIG. 3) and a blade 21 that makes possible the cutting of the continuous structure coming out of the passage 19 into pieces 22, each rib of which includes a well-defined number of folds.

The marking rollers 12 and 13 are intended to mark on the two sides of the strip, respectively, hollow impressions for the purpose of locating and facilitating the formation of ribs and folds, and each impression punched into one of the sides of the strip corresponds in the final structure to the bottom of a cavity worked into the said side and at the same time to the ridge of a rib or projecting fold in the same position on the opposite side.

Each one of the impressions is made by a straight or practically straight projecting "line" on one of the two rollers, and the lines are best produced by the edge of a blade inserted in the roller.

In order to form the folded ribs 3, the lines under consideration are divided into two groups, both located on each roller in the same shape, namely:

- a first set of lines 23 extend along annular lines cut at a zigzag pattern, each running around the roller under consideration, and the lines are parallel to each other and equidistant,
- and a second set of lines 24, in the shape of straight segments running parallel to the axis of the roller under consideration, beginning from the annular points 25 of the zigzagging lines 23, following the external bisectors of the angles formed between those lines at those points.

The second set of lines 24 that originate from two successive lines 23, and that are directed against each other, partially overlap each other.

Figure 4:
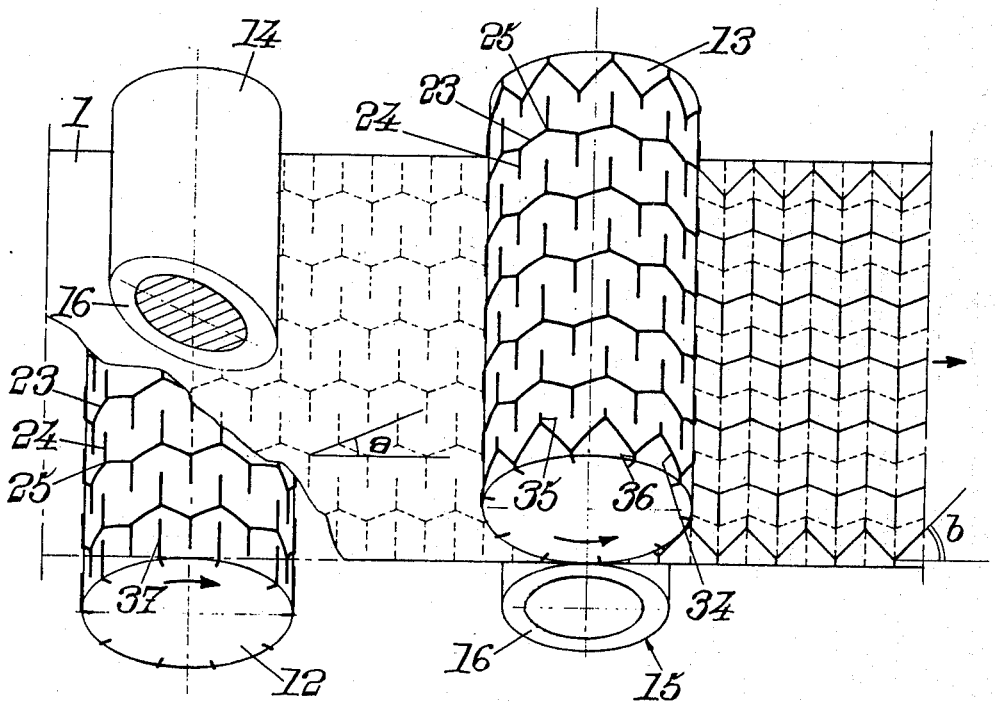
FIG. 4 is a fragmentary view on an enlarged scale of the marking rollers in such a machine.

FIG. 4 shows in dotted lines the impressions punched into the lower side of the strip 1 by the roller 12 and in continuous lines the impressions punched into the upper side of the strip by the roller 13.

The angle *a* formed between each line 23 and a plane perpendicular to the axis of the roller concerned (or, which amounts to the same thing, between each impression corresponding to a line 23 and the direction of the length of the strip 1) has a relatively large amplitude, generally ranging between 10° and 30°, preferably between 15° and 20°.

The marking rollers might have different diameters, but preferably their diameters should be identical.

The rollers are driven synchronously, so that the impressions marked on the two sides of the strip are in the correct position in relation to each other, which is obviously essential in order that the cavities made in one of the sides correspond to the ribs projecting out of the opposite side and vice versa.

Each marking roller might work together with a counter-roller having a hard lateral surface, and such surface would then be cut by grooves opposite the marking lines of its corresponding roller; in such case, each roller could also be so arranged as to play the role of a counter-roller in relation to the other roller.

In the method of construction illustrated, each marking line pushes the strip 1 locally into the relatively soft surface layer of the connected counter-roller 14, 15.

The driving rollers 17 and 18 might be eliminated by causing the marking rollers and counter-rollers themselves to assume their driving function. But the existence of these rollers 17 and 18 may be advantageous as a result of their smooth surface and of their small diameter, which make possible to place them in the immediate vicinity of the entrance of the passage 19, having a gradually changing section, thereby exerting pressure on the marked strip just before its entry into such passage.

The two lateral walls 26, 27 (FIG. 6) of the said passage 19 converge toward its end (direction of the arrow F), while its lower and upper walls 28 and 29 (FIG. 5) instead diverge toward its end, in such manner that along the entire length of the passage 19 the structure that is being processed remains tightly enclosed by the passage, and the top part of the ribs slide along the two diverging walls 28 and 29.

The two diverging walls also show smooth guiding ribs 30, the height of which increases toward the end of the passage and the median lines of which practically follow the direction of movement of the structure, while slightly converging toward the end, and these median lines run along the median lines of the cavities included among the folded ribs to be formed.

The guiding ribs 30 projecting out of the lower wall 28 overlap those that project out of the upper wall 29 in such manner that they leave open between them an opening with a winding shape crosswise, in which the strip 1 is pushed and forced to fold, forming the folded ribs along the impressions marked on its two sides.

The guiding ribs 30 may consist of small moldings fitted to the walls under consideration, made of metal, glass, plastic or any other material having a hard, smooth surface, with a low friction coefficient and wear-resistant. The guiding ribs may also be built in a single piece with the said walls.

As it appears in FIGS. 5 to 9, the transverse section of the passage 19 gradually evolves from a shape corresponding to a simple thin straight opening having the same width as the strip 1 at the entrance of the passage to a practically rectangular shape closely enveloping the folded structure obtained at the end of the said passage.

In certain cases, in order to facilitate the formation of ribs and folds in the strip, it is possible to place in contact with it the grooved lateral faces of the disks 31 (FIG. 2), the profiles of which correspond, at least in part, to the opposite of those that the structure undergoing processing is intended to assume at the place under consideration.

The said profiles and the grooves in the disks may be only partially complementary; each groove may be composed of simple pieces with rounded heads arranged to insert themselves in the cavities made in the structure to mark them more deeply, if necessary.

The disks 31 may be placed on one side of the strip only or on both its sides; each partially goes through a window 32 cut into one of the two walls 28 and 29.

They may be driven synchronously with the marking rollers, at a speed of their circumference reduced in relation to the speed at which the strip enters the passage; the reduction ratio is a function of the amount of folding at the place under consideration.

They may also be mounted right on their shaft if the folding at that place is sufficiently advanced to ensure that they can be driven by simple contact.

At the end of the passage 19, additional devices may be fitted to slow down the progress of the structure that has been formed.

Such devices may consist in a fixed rigid or elastically deformable wall 33, placed directly above the structure coming out of the passage and rubbing against it.

The braking devices may also consist of an endless belt, either continuous or composed of a succession of plates articulated in relation to each other, driven at a constant speed considerably lower than the speed at which the strip enters the passage; such speed would be determined specifically as a function of the degree of the desired longitudinal tightness of the folded structure coming out of the machine.

In certain cases, in order to avoid the appearance of instances of jamming at the relatively narrow final outlet of the guide passage, it may be useful to provide for mobile means of support to facilitate the exit of the folded structure out of the passage. Such means of support may consist, for example, of endless belts, schematically illustrated in FIG. 3 by the mixed lines 45, placed along the two edges and/or the two sides of the structure, respectively, and prolonging the corresponding walls of the passage beyond its outlet. The belts are mounted either free, so as to be freely driven simply by contact of the structure against them, or driven at the desired speed of sliding of the structure at that place, and the working pieces of such belts are supported so as to remain flat.

The operation of the machine that has been described is as follows: The strip 1, unwound by the assembly 8, 9 at a constant linear speed, after possibly having passed through the chamber 10 for the purpose of regulating its hygrometric properties, passes between the marking rollers 12 and 13, which print the marking impressions on its two sides, then is pushed into the guide passage 19, inside which it is automatically compressed lengthwise and across, thus forming its ribs and the folds of such ribs.

As it comes out of the passage, after its folds have been counted by the device 20, the folded structure is cut by the blade 21 into pieces 22, in which each rib 3 includes a few half a score folds, and each piece is suitable for forming, subsequently, a filter element.

In the description of the folding machine given above, no mention has been made of the formation of the longitudinal margins 6 of the folded structure, which are themselves folded along a succession of dihedral angles, the ridges 7 of which are oriented transversely. The margins, the presence of which appears to be very useful in practice, also for the subsequent production of filter cartridges with the pieces 22, as well as for the proper operation of the folding machine, are made in the following manner.

In the marking area, special marking lines are provided at the edges of the active areas of the marking rollers, that is, in those parts of such rollers that are actually used in marking the strip; in the method of construction illustrated, in which the axes of the rollers have a length equal to the width of the strip 1, the edges are located at the two extremities of the axes on the lateral surfaces of the said rollers.

On each one of the edges of one of the two marking rollers, as defined above (roller 13, FIG. 4), an annular marking line 34 is fitted, cut along a zigzagging pattern of the same type as the other annular zigzagging lines 23, but the segments that compose it are inclined, in relation to a plane perpendicular to the axis of the roller under consideration, by an angle $b$ much wider than the angle $a$ above. The angle $b$ is preferably equal to $45° + a/2$, that is, 55° if $a$ is equal to 20°.

Moreover, the marking lines of the second type, corresponding to the lines 24 above and originating from the angular points of the two lines 34, respectively, along the external bisectors of the angles formed by those lines, are of two types. The first, 35, go toward the middle of the roller under consideration, are much shorter than the other lines 24 and extend in the direction of the neighboring zigzagging line 23 up to the same relative depth of overlapping as the other lines 24 in the central part of the roller. The second, 36, that go toward the outside of the roller, extend up to the end of the edge under consideration.

On each one of the "edges", as defined above, of the other roller (12, FIG. 4), there are fitted straight transversal lines 37 that extend from the end of the edge under consideration toward the nearest zigzagging line 23, following the internal bisectors of the angles formed by such line and open in the direction of such edge. The lines 37 are each interrupted at a distance from the corresponding angular point of the said line 23 equal to the length of a "short" line 35.

The folded margins 6 that are produced by this marking — and particularly the ridges 7 of their folds — remain perpendicular to the lateral walls 26, 27 of the passage 19 during the movement of the strip through the passage. This contributes substantially to the automatic transversal compression of the strip, which results in the formation of the longitudinal ribs. In other words, the sections of those margins 6 constantly slide against the walls and are pushed back by the walls without any risk of lying on the latter and thus being subjected in turn to the transverse pressure needed for the formation of the longitudinal ribs.

In order to render the ridges 7 even more accurately perpendicular to the lateral walls 26, 27 of the passage, the following arrangement is also preferably resorted to, taking into account the fact that the strip marked in the manner described above tends to curve a little sideways in the process of changing shape. Following the lateral walls 26, 27 of the passage 19 from the entrance to the exit of such passage, they gradually incline toward the outside until they reach an inclination of the order of 15° to the vertical in the middle of the passage (see FIG. 8), then gradually straighten up until they become vertical again at the exit of the passage.

The inclination of each lateral wall is matched by a slight depression in the lower wall 28 in the vicinity of the foot of the lateral wall. Such a depression, visible under 44 in FIG. 8, appears in the shape of a lateral channel, the smooth bottom of which is practically perpendicular to the lateral wall under consideration and has a width practically equal to the length of a line 36.

It should be noted that each channel 44 is intended to receive the ridges 7 while they are being formed in the folded margins 6, corresponding to the marking lines 36. Thus, the two channels are cut into the lower wall 28 of the passage 19 if the lines 36 mark their impressions in the upper side of the strip, as shown in the illustration, but in the opposite case (which assumes the exchange of the marking roller for all the lines 34, 35, 36 and 37), the channels would be cut into the upper wall 29 of the passage, and the inclination of the lateral walls would then be reversed in relation to the inclination described above. It is also possible to arrange a channel placed at the foot of a lateral wall, in the adjacent lower wall 28, and the other at the top of the other lateral wall, in the adjacent upper wall 29, if the two rings of marginal marking lines 36 were arranged on the lower roller 12 and on the upper roller 13, respectively, instead of being both on the same roller.

At the same time, the angle of convergence of the lateral walls 26 and 27 of the passage is gradually changed. The angle is very small, or zero, at the entrance and at the exit of the passage and reaches its maximum amplitude in the central part of the latter, as clearly shown in FIG. 6, which gives the median line of each of the said walls the general shape of an elongated S.

Figure 10:
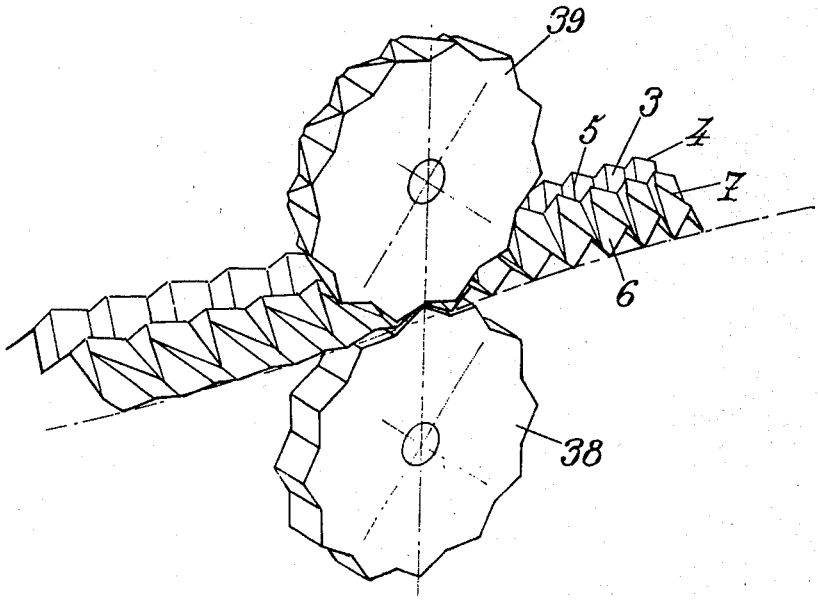
FIG. 10 is a fragmentary perspective view of a pair of grooved wheels included in the machine described above to facilitate the folding of the margins.

In order to facilitate the folding of the margins, it is advisable to cause each of them to pass between two grooved wheels 38, 39 (FIGS. 2 and 10), the rims of which show profiles that substantially reproduce, in reverse image, those of the folds to be formed in the place under consideration. In the case shown in the illustrations, the lower wheel 38, intended to cut the cavities corresponding to the transversal lines 37 above, appears in the shape of a purely prismatic star, while the design of the upper wheel 39 is a little more complicated, because it is fitted not only to the upper side of the folded margin, but also to the outer side of the first lateral rib in the structure.

As in the case of the disks 31, the wheels 38 and 39 project partially across windows 40 cut into the walls 28 and 29 of the passage 19.

The wheels 38 and 39 may also be driven synchronously with the marking rollers, and an appropriate and constant reduction ratio may be applied to the corresponding speeds at the circumference to take the folding into account. However, the wheels might also be mounted free if their simple contact in the place under consideration with the folded structure, or at least the contact between the upper wheel and the side of the corresponding lateral rib in the structure is sufficient to ensure the desired drive.

The part of the passage 19 where the wheels 38 and 39 should preferably be located is that indicated above, corresponding at the same time to the maximum inclination of the lateral walls 26 and 27 in relation to the vertical and to the widest angle of convergence of such walls toward the exit (the angle of convergence may be considered to be the angle formed between the median horizontal line of the wall under consideration and the longitudinal direction of movement of the strip).

The guiding ribs 30 should also preferably end at that place, when they have then reached their maximum height; beyond that place, as a result of the gradual narrowing of the distance across the folds of the contiguous ribs 3 of the structure, there remains no longer sufficient space between the folds to place there the said guiding ribs; at the limit, the contiguous folds under consideration very slightly overlap each other, or at least become practically connected.

Figure 2:
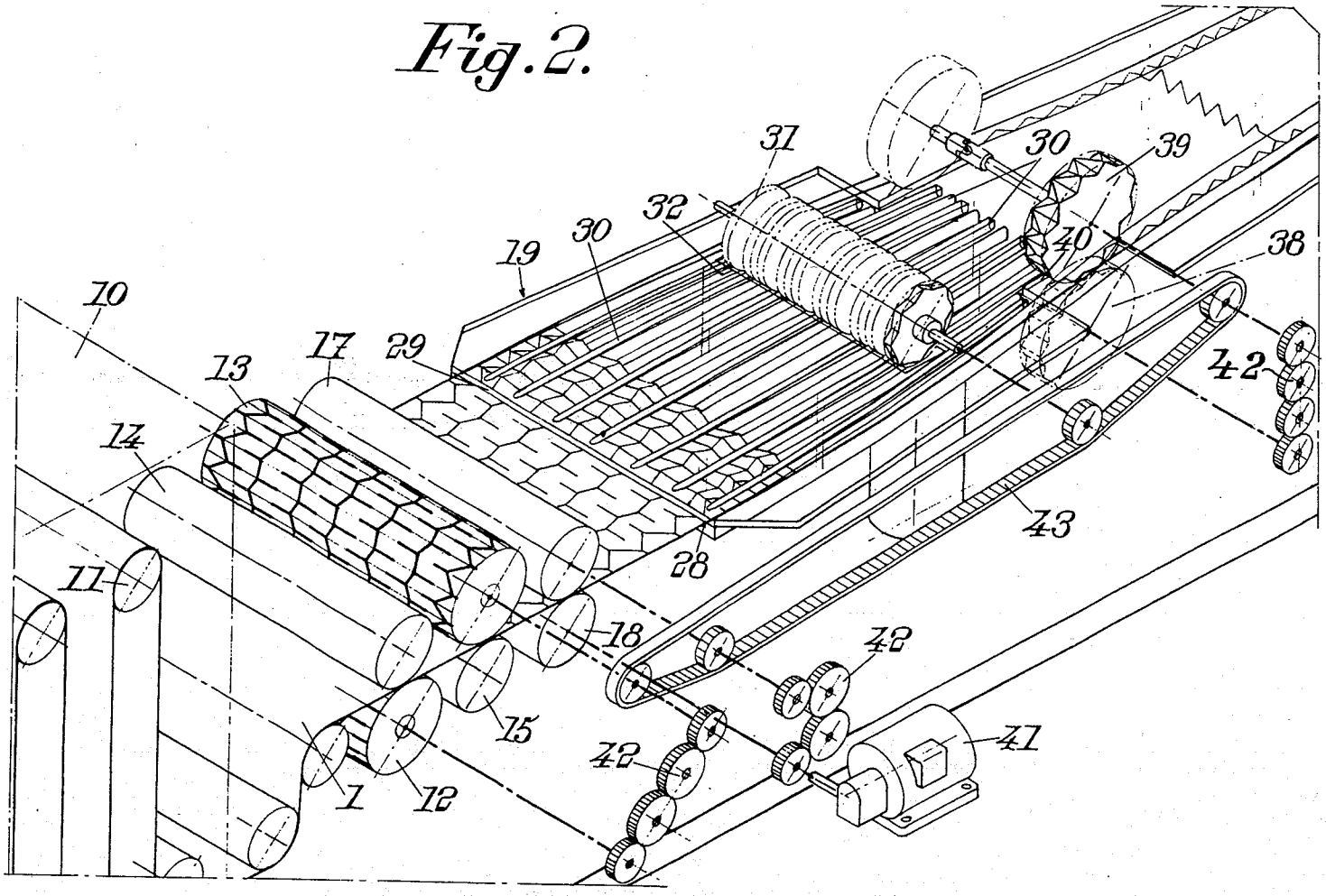
Figure 3:
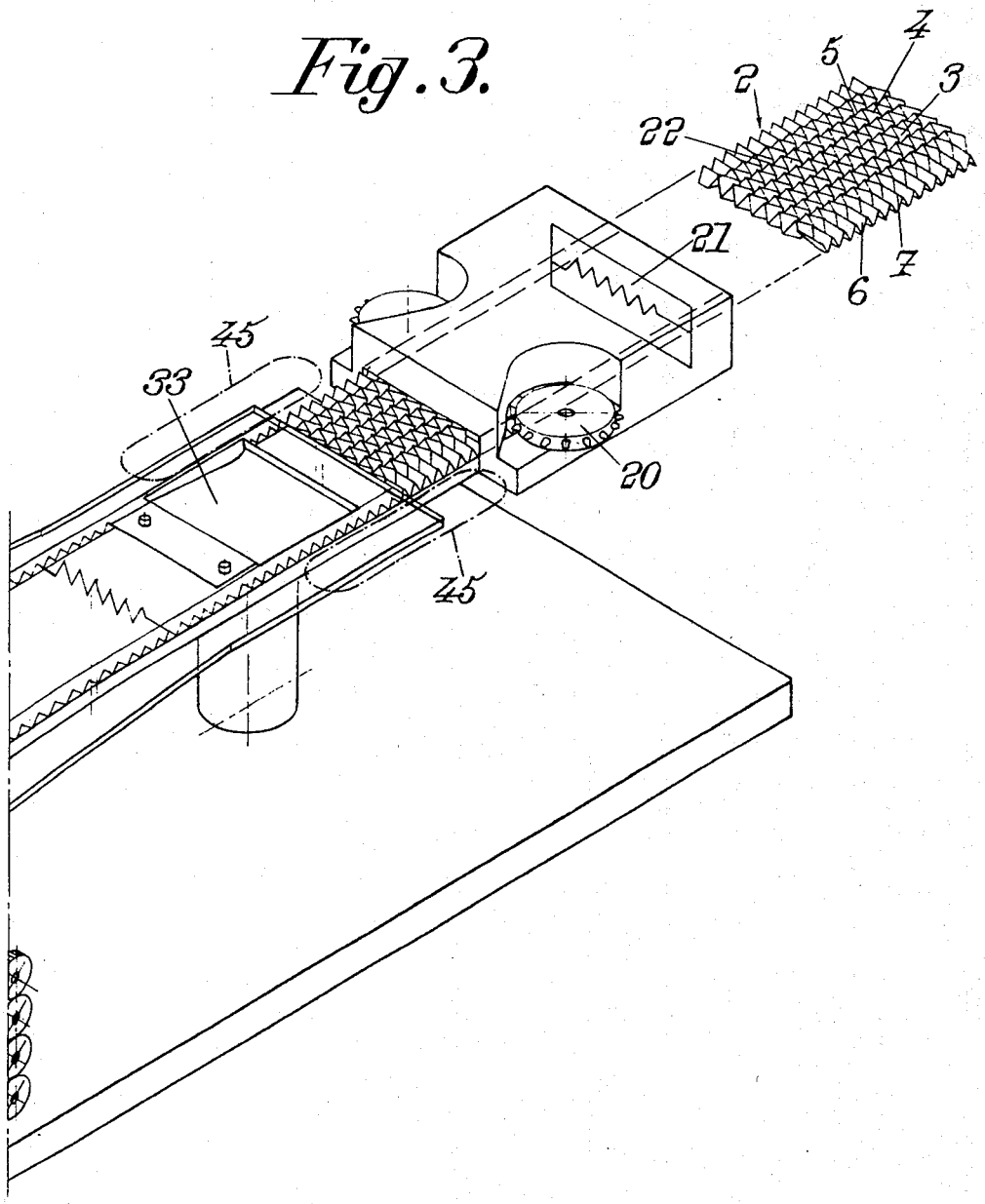

In FIG. 2, the upper wall 29 of the passage has been imagined as being transparent, in order to show the guiding ribs 30 in their entire length. In practice it is not at all necessary that they be transparent.

In FIG. 2, the marking rollers 12, 13, the driving rollers 17, 18, the disks 31 and the wheels 38 and 39 have been represented as being driven synchronously by a single motor assembly 41, through the pinions 42 and a grooved chain 43.

Thus, irrespective of the method of construction followed, a machine is finally obtained that makes possible the continuous manufacture of folded structures of filtering paper or similar material, and the construction and operation of such machine appear with sufficient clarity from the preceding description.

Such a machine offers numerous advantages in comparison with those known until now, particularly with respect to:

- its sturdiness and its low cost, particularly as a result of the fact that it does not employ any parts having alternating motions,
- the high production rates that it makes possible,
- the large size that it makes possible to obtain very easily in the folded structures produced, with a great flexibility of choice.

As is self-evident, and also as it appears from the preceding description, the invention is not limited to those methods of application and construction that have been more specifically described. On the contrary, it encompasses all its alternatives, notably those in which the folded structure coming out of the machine would not be cut directly into pieces 22, upon exiting from the passage 19, but would be subjected to further processing before being cut.

What is claimed is:

1. A machine for manufacturing, out of a thin strip of filtering material, a flat and flexible folded structure that presents on each one of its two sides a series of parallel folded ribs showing ridges in a zigzagging pattern and corresponding to a series of cavities on the other side, and where each ridge of a rib is connected to each zigzagging line at the bottom of a contiguous cavity by a folded side consisting of a succession of facets in the shape of parallelograms, said machine including: two marking rollers with parallel axes, placed on either side of the direction of movement of the strip, respectively, and driven synchronously for the purpose of marking on the two sides of the strip impressions indicating the ridges of the ribs and the folds in the folded structure, where each roller presents a first and a second set of projecting marking lines corresponding, the first set, to the ridges of the ribs or to the bottom of the cavities, and the second set, to the folds in the sides of such ribs or cavities, respectively; means forming a guide passage limited laterally by two walls converging toward its exit; means to push the structure that is undergoing folding into the passage at a constant speed, characterized by the fact that the marking is such that the folded ribs run along the length of the strip and that the passage is fixed and enclosed vertically by two smooth walls, gradually diverging toward its exit in such manner that the transversal section of the entrance of the passage is practically complementary to the flattened rectangular section of the strip marked and not folded and that each section of the said passage by a vertical plane closely envelops the section of the structure that is being folded cut along the same plane, and the two diverging walls also present longitudinal smooth guiding ribs, the height of which increases toward the exit and which run along the median lines of the cavities enclosed between the folded ribs to be formed.

2. A machine as in claim 1 wherein the marking is also such that the margins of the structure undergoing folding remain practically perpendicular at any point to the lateral walls of the passage, against which they slide.

3. A machine as in claim 1 wherein the marking is also such that the angle ($a$) formed between the longitudinal direction of the strip and the zigzagging marking impressions on such strip intended to indicate the ridges of the ribs ranges between 10° and 30°.

4. A machine as in claim 1 wherein the first set of marking lines run on each of the two marking rollers along annular zigzagging parallel and equidistant lines, centered on the axes of such rollers, and by the fact that the second set of marking lines run on each of the said rollers parallel to their axes from the angular points of the said zigzagging lines along the external bisectors of the corresponding angles, and the second set of lines that originate from two successive annular zigzagging lines and are oriented toward each other partially overlap each other.

5. A machine as in claim 1 wherein the two marking rollers are placed in echelon in relation to each other along the direction of passage of the strip, and each of them is connected to a counter-roller located on the opposite side of the strip.

6. A machine as in claim 1 wherein a pair of driving rollers is inserted between the marking rollers and the entrance of the guide passage.

7. A machine as in claim 1 including at the exit end of the guide passage a device for the purpose of slowing down the folded structure, and such device specifically consists of a fixed rigid or elastic friction wall or an endless belt driven at a speed lower than the speed at which the strip enters the passage.

8. A machine as in claim 1 including mobile means of support to facilitate the exiting of the structure out of the guide passage.

9. A machine as in claim 2 making possible to line the folded structure with simple V-shaped folded margins, the ridges of the folds of which are practically perpendicular to the lateral walls of the guide passage, wherein, on the one hand, the first set of marking lines that constitute the two annular marginal zigzagging lines on one of the two marking rollers form with a plane perpendicular to the axis of the roller an angle *b* considerably wider than the angle *a* formed between the other first set of marking lines on the said roller and the said plane, and by the fact that, on the other hand, the other marking roller presents on its marginal area a third set of projectng marking lines parallel to the axis of the roller and extending at least from the transversal planes of the roller that correspond to the edges of the strip, along the internal bisectors of the angles formed between the marginal annular zigzagging lines adjacent on such planes.

10. A machine as in claim 9 wherein the angle *b* is practically equal to $45° + a/2$.

11. A machine as in claim 9 wherein on the first marking roller, the second set of marking lines originating from the marginal annular zigzagging lines and running toward the central part of the roller are considerably shorter than the second set of marking lines, originating from the other annular zigzagging lines.

12. A machine as in claim 9 wherein the median line of each of the lateral walls of the guide passage has the general shape of an elongated S.

13. A machine as in claim 9 wherein from their upper extremity, which corresponds to the entrance of the guide passage, the lateral walls of the passage are gradually inclined toward the outside, beginning initially in a vertical position, and then straighten up again gradually, until they are vertical again at the exit of the passage.

14. A machine as in claim 1 including a set of wheels, that partially project from windows cut into at least one of the diverging faces of the guide passage, the contour of such wheels and their position being arranged in such manner that they work together with the structure that is undergoing folding and by touching such structure make possible to rectify and complete its folding.

15. A machine as in claim 14 wherein four of the wheels are placed two by two on either side of each margin of the structure undergoing folding, practically at the place along the passage where the guiding ribs reach their maximum height.

* * * * *

UNITED STATES PATENT OFFICE

CERTIFICATE OF CORRECTION

Patent No. 3,998,140 Dated December 21, 1976

Inventor(s) Claude Maurice Andre

It is certified that error appears in the above-identified patent and that said Letters Patent are hereby corrected as shown below:

In the heading:

Item [73] should read:

Assignee: Sofited, 2 Saint Quen, France

Signed and Sealed this

Thirty-first Day of May 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,998,140 Dated December 21, 1976

Inventor(s) Claude Maurice Andre

It is certified that error appears in the above-identified patent and that said Letters Patent are hereby corrected as shown below:

In the heading:

Item [73] should read:

Assignee: SOFITED, Saint Ouen, France

This certificate supersedes Certificate of Correction issued May 31, 1977.

Signed and Sealed this

Eleventh Day of October 1977

[SEAL]

Attest:

RUTH C. MASON
Attesting Officer

LUTRELLE F. PARKER
Acting Commissioner of Patents and Trademarks